US010415924B1

(12) United States Patent
Huang

(10) Patent No.: US 10,415,924 B1
(45) Date of Patent: Sep. 17, 2019

(54) THREE AXIS ADJUSTABLE ARROW REST

(71) Applicant: Dorge O. Huang, Henry, IL (US)

(72) Inventor: Dorge O. Huang, Henry, IL (US)

( * ) Notice: Subject to any disclaimer, the term of this patent is extended or adjusted under 35 U.S.C. 154(b) by 0 days.

(21) Appl. No.: 16/049,062

(22) Filed: Jul. 30, 2018

(51) Int. Cl.
*F41B 5/22* (2006.01)
*F41B 5/14* (2006.01)
*F41G 1/38* (2006.01)
*F41B 5/12* (2006.01)

(52) U.S. Cl.
CPC ..... *F41B 5/143* (2013.01); *F41G 1/38* (2013.01); *F41B 5/12* (2013.01)

(58) Field of Classification Search
CPC ..... F41B 5/143
See application file for complete search history.

(56) References Cited

U.S. PATENT DOCUMENTS 5,062,407 A * 11/1991 Newbold ..... F41B 5/143 124/24.1
5,117,803 A * 6/1992 Johnson ..... F41B 5/143 124/24.1
5,535,728 A * 7/1996 Prodigo ..... F41B 5/143 124/44.5
8,544,458 B1 * 10/2013 LoRocco ..... F41B 5/143 124/44.5
8,967,131 B2 * 3/2015 Hunt ..... F41B 5/143 124/44.5
8,967,133 B1 3/2015 Huang

* cited by examiner

*Primary Examiner* — John A Ricci
(74) *Attorney, Agent, or Firm* — Donald J. Ersler

(57) ABSTRACT

A three axis adjustable arrow rest preferably includes a front bracket, a bow mounting bracket, a pair of guide rods, a linear carriage, a lateral carriage and an arrow support frame. One end of the pair of guide rods are retained in the front bracket. The linear carriage is adjustably retained on the pair of guide rods by rotation of a linear adjustment screw. An opposing end of the pair of guide rods are retained by the bow mounting bracket. The lateral carriage is adjustable retained by the linear carriage with a lateral adjustment screw. A vertical stem is adjustably retained in the lateral carriage with a vertical adjustment screw. The arrow support frame is attached to a top of the vertical stem. The arrow support frame includes a plurality of arrow shaft adjustment screws for supporting an arrow shaft of an arrow.

11 Claims, 7 Drawing Sheets

THREE AXIS ADJUSTABLE ARROW REST

BACKGROUND OF THE INVENTION

1. Field of the Invention

The present invention relates generally to hunting and more specifically to a three axis adjustable arrow rest, which allows three-axis adjustment relative to an arrow placed therein.

2. Discussion of the Prior Art

It appears that the prior art does not disclose a three axis adjustable arrow rest, which is preferably mounted to a cross bow and allows support of an arrow to be adjusted to provide optimal null point support for the arrow. U.S. Pat. No. 8,967,133 to Huang discloses a two axis micro-adjusting device with a single locking mechanism. U.S. Pat. No. 8,967,133 is hereby incorporated into this application in its entirety.

Accordingly, there is a clearly felt need in the art for a three axis adjustable arrow rest, which is preferably mounted to a cross bow and allows support of an arrow to be adjusted to provide optimal null point support for the arrow.

SUMMARY OF THE INVENTION

The present invention provides a three axis adjustable arrow rest, which allows three-axis adjustment relative to an arrow placed thereupon. The three axis adjustable arrow rest (three axis arrow rest) preferably includes a front bracket, a bow mounting bracket, a pair of guide rods, a linear carriage, a lateral carriage and an arrow support frame. The front bracket includes a pair of guide rod bores, an adjustment counter bore and a lock threaded hole. One end of the pair of guide rods are retained in the pair of guide rod bores with a pair of rod fasteners. An axis of the lock threaded hole is formed perpendicular to an axis of the adjustment counter bore.

The linear carriage includes a carriage base and a t-nut retainer block. The t-nut retainer block extends from a top of the carriage base. The carriage base includes a pair of guide rod bores and an adjustment threaded hole. The t-nut retainer block includes a t-nut slot and a flange clearance slot. The t-nut slot is formed in a front of the t-nut retainer block and the flange clearance slot is formed in a top of the t-nut retainer block behind the t-nut slot. The t-nut slot communicates with the flange clearance slot to allow side to side movement of a t-nut. A t-nut adjustment hole is formed through opposing side walls of the t-nut retainer block. An opposing end of the pair of guide rods are inserted through the pair of guide rod bores in the carriage base. A connection boss is formed on a front of the t-nut retainer block.

The bow mounting bracket includes a mounting plate and a mounting projection. The mounting projection extends outward perpendicular from a rear of the mounting plate. A pair of guide rod bores and an adjustment hole are formed through a bottom of the mounting plate. An opposing end of the pair of guide rods are retained in the pair of guide rod bores with a pair of rod fasteners. A linear adjustment screw includes a turn knob and an adjustment threaded shaft. The linear adjustment screw is inserted through the adjustment counter bore; threaded into adjustment threaded hole in the carriage base; and rotatably supported by the adjustment hole. A threaded fastener is threaded into the lock threaded hole to prevent rotation of the turn knob of the linear adjustment screw. A pair of mounting counter bores are formed through a length of the mounting projection. A pair of threaded fasteners are inserted into the pair of mounting counter bores and threaded into a front of a cross bow or the like.

The lateral carriage includes a stem retainer and an adjustment projection. The adjustment projection extends from a bottom of the stem retainer. The stem retainer includes a stem opening with at least one flat and a slit through a side wall of the stem retainer. The stem opening is sized to slidably receive a vertical stem. A fastener counter bore is formed on one side of the slit and a clearance hole is formed through an opposing side of the slit. The slit allows the through opening to be reduced in size to lock the vertical stem at a particular height. The adjustment projection includes a first leg and a second leg. The first leg extends from a bottom of the stem retainer. The second leg extends perpendicularly outward from a bottom of the first leg. An axis of an adjustment counter bore is formed in the second leg, concentric with an axis of the stem opening. A threaded hole is formed in a bottom of the vertical stem to receive a vertical adjustment screw. The vertical adjustment screw is retained in the adjustment counter bore. The vertical stem also includes a cross section with at least one flat. A support flange extends outward from an outer perimeter near a top thereof. A retention threaded hole is formed in a top thereof. A carriage slot is formed in a rear of the stem retainer to receive the connection boss of the linear carriage. The lateral carriage is secured to the linear carriage with a fastener and a t-nut.

The t-nut includes a nut body, a flange base, an adjustment threaded hole and a threaded retention hole. The nut body preferably includes a round cross section. The flange base extends outward from a bottom of the nut body. An axis of the adjustment threaded hole is formed through the nut body, parallel with a bottom of the flange base. An axis of the threaded retention hole is formed perpendicular to the axis of the adjustment threaded hole. The flange base is oriented for insertion through the t-nut slot and then rotated into the flange clearance slot. A fastener is inserted through the fastener counter bore and clearance hole in the stem retainer and threaded into the threaded retention hole of the nut body to secure the lateral carriage to the linear carriage.

The arrow support frame includes a base frame, a vertical leg and a horizontal leg. The vertical leg extends upward from one end of the base frame. The horizontal leg extends inward from a top of the vertical leg. A stem opening is formed through the base frame to receive a top of the vertical stem. A support fastener is used to attach the arrow support frame to the vertical stem. A pair of angled arrow shaft threaded holes are formed in opposing ends of the base frame to receive a pair of arrow shaft adjustment screws. An arrow shaft threaded hole is formed through the horizontal leg to receive a third arrow shaft adjustment screw. A level pocket is preferably formed in a top of the horizontal leg to receive a bubble level. The three axis arrow rest is preferably mounted to a cross bow, such that a top of a bubble level is viewable through a scope to level the cross bow with the horizon.

A bubble level may be made as an integral portion of a scope. The bubble level can be located inside the scope near a middle of a length and near a bottom of the case wall. The bubble level may also be located in front of an exit lens, near a bottom of the case wall. A bubble level cap may also be pushed over an exit end of the scope. The bubble level cap includes a cap member and a bubble level. The cap member includes a counter bore, which is sized to receive an outer diameter of a scope case exit end. A level hole is formed through the cap member near a bottom of the smaller counter bore diameter to receive the bubble level.

Accordingly, it is an object of the present invention to provide a three axis adjustable arrow rest, which is preferably mounted to a cross bow and allows support of an arrow to be adjusted to provide optimal null point support for the arrow.

Finally, it is another object of the present invention to provide scopes with internal and external levels, which enables level sighting to be made with a weapon.

These and additional objects, advantages, features and benefits of the present invention will become apparent from the following specification.

DETAILED DESCRIPTION OF THE PREFERRED EMBODIMENTS

Figure 2:
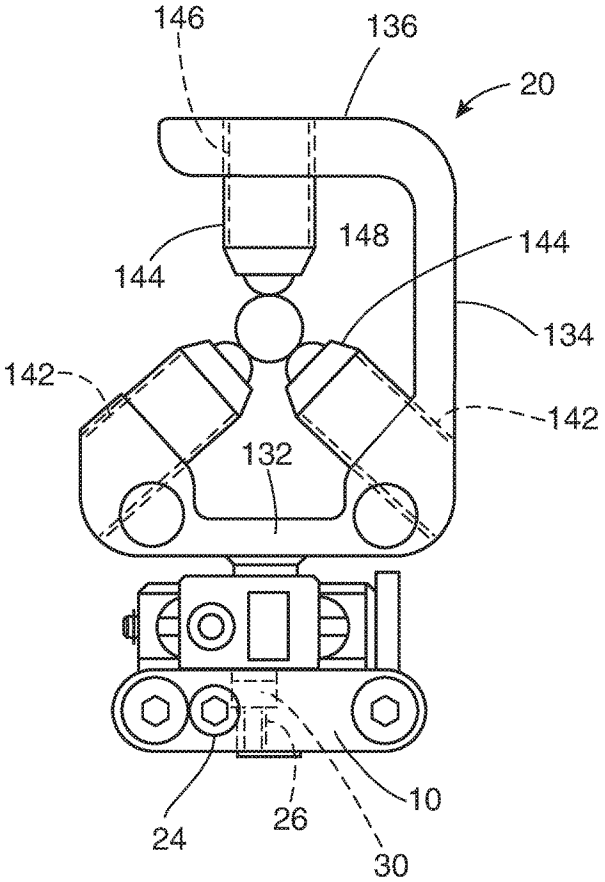
FIG. 2 is a front view of a three axis arrow rest with a rear bracket removed in accordance with the present invention.
Figure 1:
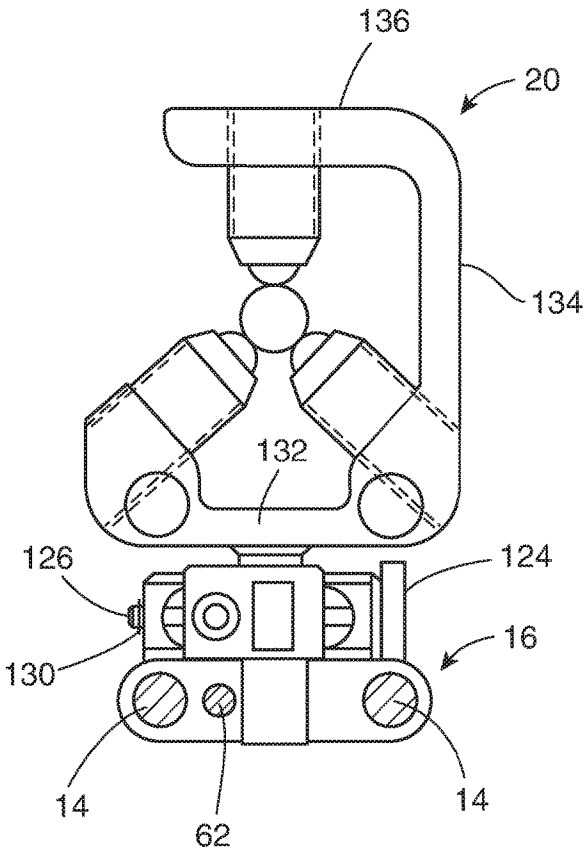
FIG. 1 is a front view of a three axis arrow rest with front and rear brackets removed in accordance with the present invention.
Figure 3:
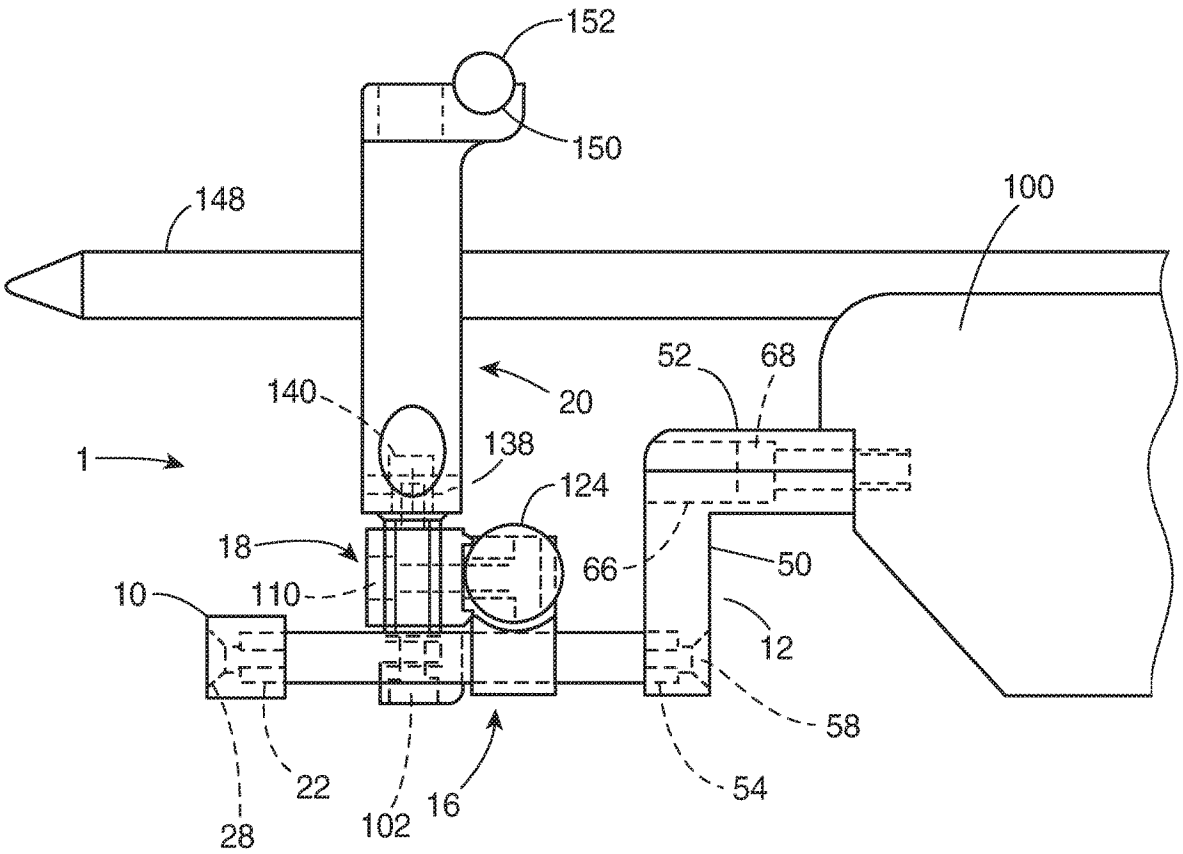
FIG. 3 is a side view of a three axis arrow rest attached to a front of a cross bow in accordance with the present invention.
Figure 15:
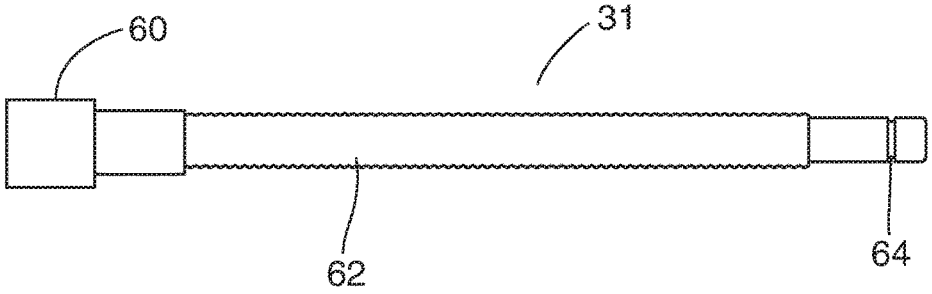
FIG. 15 is a side view of a linear adjustment screw of a three axis arrow rest in accordance with the present invention.

With reference now to the drawings, and particularly to FIG. 3, there is shown a side view of a three axis arrow rest 1. With reference to FIGS. 1-2, the three axis arrow rest 1 preferably includes a front bracket 10, a bow mounting bracket 12, a pair of guide rods 14, a linear carriage 16, a lateral carriage 18 and an arrow support frame 20. The front bracket 10 includes a pair of guide rod bores 22, an adjustment counter bore 24 and a lock threaded hole 26. One end of the pair of guide rods 14 are retained in the pair of guide rod bores 22 with a pair of rod fasteners 28. An axis of the lock threaded tap 26 is formed perpendicular to an axis of the adjustment counter bore 24. With reference to FIG. 15, a threaded fastener 30 is used to lock a linear adjustment screw 31 in the adjustment counter bore 24.

Figure 12:
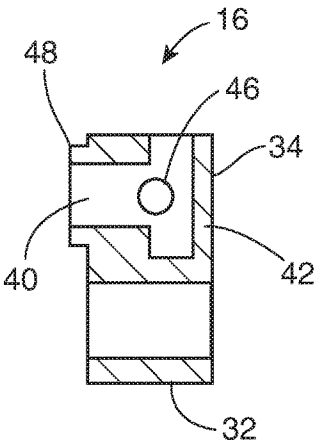
FIG. 12 is a cross sectional view of a linear carriage cut through FIG. 11 of a three axis arrow rest in accordance with the present invention.
Figure 10:
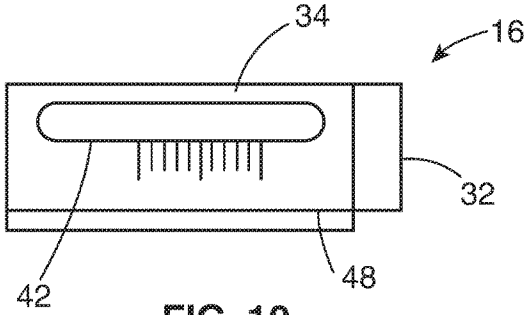
FIG. 10 is a top view of a linear carriage of a three axis arrow rest in accordance with the present invention.
Figure 11:
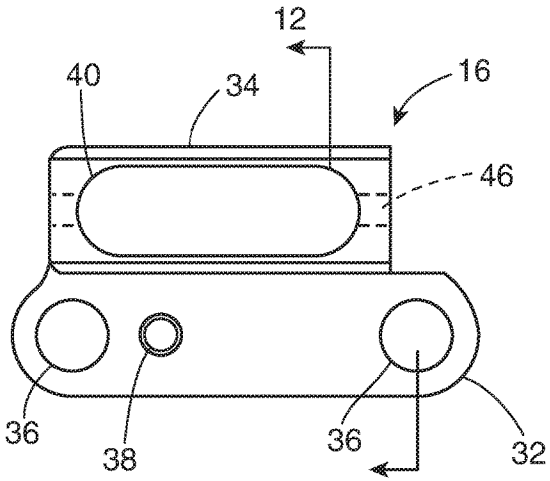
FIG. 11 is a front view of a linear carriage of a three axis arrow rest in accordance with the present invention.

With reference to FIGS. 10-12, the linear carriage 16 includes a carriage base 32 and a t-nut retainer block 34. The t-nut retainer block 34 extends from a top of the carriage base 32. The carriage base 32 includes a pair of guide rod bores 36 and an adjustment threaded tap 38. The t-nut retainer block 34 includes a t-nut slot 40 and a flange clearance slot 42. The t-nut slot 40 is formed in a front of the t-nut retainer block 34 and the flange clearance slot 42 is formed in a top of the t-nut retainer block 34 behind the t-nut slot 40. The t-nut slot 40 communicates with the flange clearance slot 42 to allow side to side movement of a t-nut 44. A t-nut adjustment hole 46 is formed through opposing side walls of the t-nut retainer block 34. An opposing end of the pair of guide rods 14 are inserted through the pair of guide rod bores 36 in the carriage base 32. A connection boss 48 is formed on a front of the t-nut retainer block 34.

Figure 4:
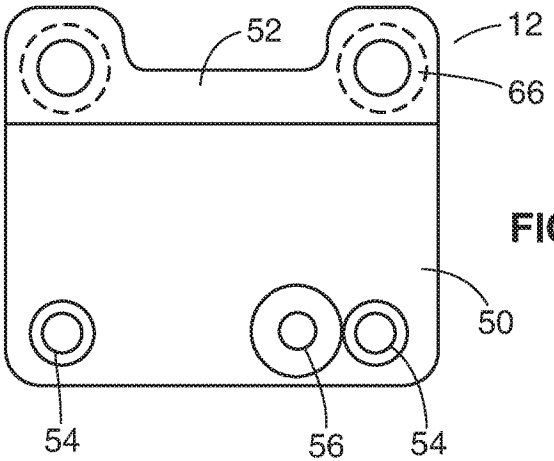
FIG. 4 is a rear view of a rear bracket of a three axis arrow rest in accordance with the present invention.
Figure 6:
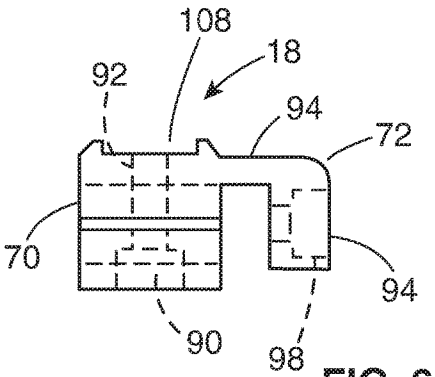
FIG. 6 is a side view of a lateral carriage of a three axis arrow rest in accordance with the present invention.
Figure 5:
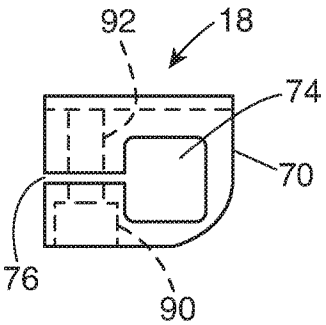
FIG. 5 is a top view of a lateral carriage of a three axis arrow rest in accordance with the present invention.

With reference to FIG. 4, the bow mounting bracket 12 includes a mounting plate 50 and a mounting projection 52. The mounting projection 52 extends outward perpendicular from a rear of the mounting plate 50. A pair of guide rod bores 54 and an adjustment hole 56 are formed through a bottom of the mounting plate 50. An opposing end of the pair of guide rods 14 are retained in the pair of guide rod bores 54 with a pair of rod fasteners 58. With reference to FIG. 15, the linear adjustment screw 31 includes a turn knob 60, an adjustment threaded shaft 62 and a lock ring groove 64. The adjustment threaded shaft 62 is inserted through the adjustment counter bore 24; threaded into adjustment threaded tap 38 in the carriage base 32; and rotatably supported by the adjustment hole 56. A snap ring (not shown) is preferably snapped into the lock ring groove 64 to retain the linear adjustment screw in the adjustment hole 56. The threaded fastener 30 is threaded into the lock threaded tap 26 to prevent rotation of the turn knob 60 of the linear adjustment shaft 31. A pair of mounting counter bores 66 are formed through a length of the mounting projection 12. A pair of threaded fasteners 68 are inserted into the pair of mounting counter bores 66 and threaded into a front of a cross bow 100.

Figure 7:
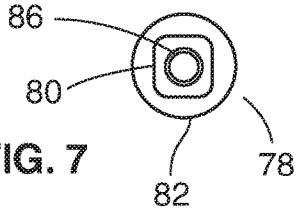
FIG. 7 is a top view of a vertical stem of a three axis arrow rest in accordance with the present invention.
Figure 8:
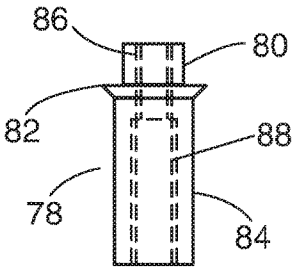
FIG. 8 is a side view of a vertical stem of a three axis arrow rest in accordance with the present invention.
Figure 9:
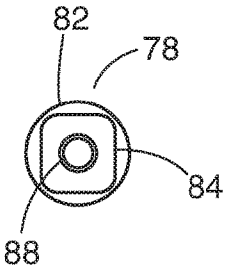
FIG. 9 is a bottom view of a vertical stem of a three axis arrow rest in accordance with the present invention.

The lateral carriage 18 includes a stem retainer 70 and an adjustment projection 72. The adjustment projection 72 extends from a bottom of the stem retainer 70. The stem retainer 70 includes a stem opening with at least one flat (stem opening) 74 and a slit 76 through a side wall of the stem retainer 70. With reference to FIGS. 7-9, the through opening 74 is sized to slidably receive a vertical stem 78. The vertical stem 78 includes a top projection 80, a flange 82 and a bottom projection 84. The top projection 80 extends upward from the flange 82 and the bottom projection 84 extends downward from the flange 82. The top projection 80 includes a cross section with at least one flat surface to prevent pivoting relative to the arrow support frame 20 and the bottom projection 84 includes a cross section with at least one flat surface to prevent pivoting relative to lateral carriage 18. A top threaded hole 86 is formed in the top projection 80. A bottom threaded hole 88 is formed in the bottom projection 84.

Figure 17:
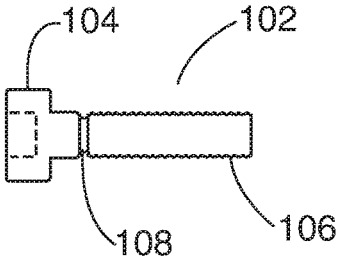
FIG. 17 is a side view of a vertical adjustment screw of a three axis arrow rest in accordance with the present invention.

A fastener counter bore 90 is formed on one side of the slit 76 and a clearance hole 92 is formed through an opposing side of the slit 76. The slit 76 allows the through opening 74 to be reduced in size to lock the bottom projection 84 of the vertical stem 18 at a particular height. The adjustment projection 72 includes a first leg 94 and a second leg 96. The first leg 94 extends from a bottom of the stem retainer 70. The second leg 96 extends perpendicularly outward from a bottom of the first leg 94. An axis of an adjustment counter bore 98 formed in the second leg 96 is concentric with an axis of the stem opening 74. With reference to FIG. 17, the bottom threaded hole 88 in the vertical stem 78 is sized to threadably receive a threaded shaft 106 of the vertical adjustment screw 102. The vertical adjustment screw 102 includes a rotation head 104, the threaded shaft 106 and a lock ring groove 108. A snap ring (not shown) is snapped into the lock ring groove 108 to rotatably retain the adjustment screw 102 in the second leg 96. Rotation of the vertical adjustment screw changes a height of the vertical stem 78. A carriage slot 108 is formed in a rear of the stem retainer 70 to receive the connection boss 48 of the linear carriage 16. The lateral carriage 18 is secured to the linear carriage 18 with a fastener 110 and a t-nut 44.

Figure 13:
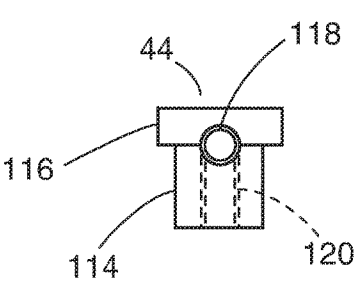
FIG. 13 is a side view of a t-nut of a linear carriage of a three axis arrow rest in accordance with the present invention.
Figure 14:
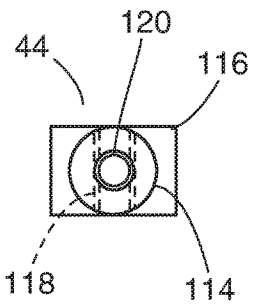
FIG. 14 is a top view of a t-nut of a linear carriage of a three axis arrow rest in accordance with the present invention.

With reference to FIGS. 13-14, the t-nut 44 includes a nut body 114, a flange base 116, an adjustment threaded hole 118 and a threaded retention hole 120. The nut body 114 preferably includes a round cross section. The flange base 116 extends outward from a bottom of the nut body 114. An axis of the adjustment threaded hole 118 is formed through the nut body, parallel with a bottom of the flange base 116. An axis of the threaded retention hole 120 is formed perpendicular to the axis of the adjustment threaded hole 118. The flange base 116 is oriented for insertion through the t-nut slot 40 and then rotated into the flange clearance slot 42. The fastener 110 is inserted through the fastener counter bore 90 and clearance hole 92 in the stem retainer 70 and threaded into the threaded retention hole 120 of the nut body 114 to secure the lateral carriage 18 to the linear carriage 16.

Figure 16:
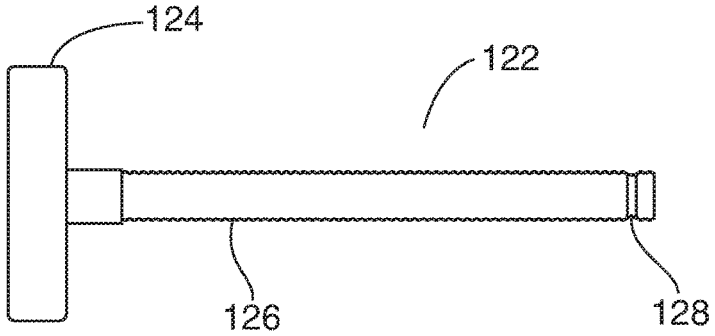
FIG. 16 is a side view of a lateral adjustment screw of a three axis arrow rest in accordance with the present invention.
Figure 18:
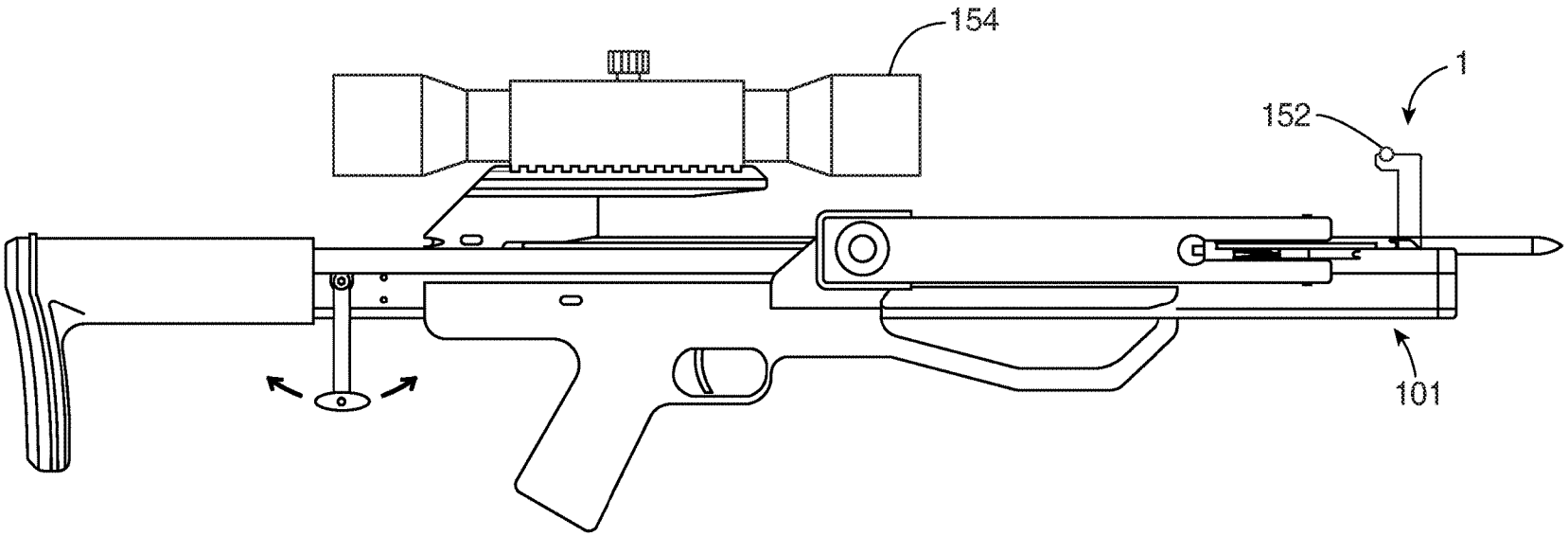
FIG. 18 is a side view of a crossbow with a scope and a three axis arrow rest attached to the crossbow, such that a bubble level is viewable through the scope in accordance with the present invention.

With reference to FIG. 16, a lateral adjustment screw 122 includes a turn knob 124, a threaded shaft 126 and a snap lock groove 128. The nut body 114 is retained in the t-nut retainer block 34; the threaded shaft 126 is inserted into one end of the t-nut adjustment hole 46; threaded into the adjustment threaded hole 118; inserted through the opposing end of the t-nut adjustment hole 46; and a snap ring 130 inserted into the snap lock groove 128. The arrow support frame 20 includes a base frame 132, a vertical leg 134 and a horizontal leg 136. The vertical leg 134 extends upward from one end of the base frame 132. The horizontal leg 136 extends inward from a top of the vertical leg 134. A stem opening 138 is formed through the base frame 132 to receive the top projection 80 of the vertical stem 78. A support fastener 140 is used to attach the arrow support frame 20 to the vertical stem 78. A pair of angled arrow shaft threaded holes 142 are formed in opposing ends of the base frame 132 to receive a pair of arrow shaft adjustment screws 144. An arrow shaft threaded hole 146 is formed through the horizontal leg 136 to receive a third shaft adjustment screw 144. The three arrow shaft adjustment screws 144 support an arrow shaft 148. A level pocket 150 is preferably formed in a top of the horizontal leg 136 to receive a bubble level 152. With reference to FIG. 18, the three axis arrow rest 1 is mounted to a cross bow 101, such that a top of the bubble level 152 is viewable through a scope 154 to level the cross bow 101 with the horizon.

Figure 20:
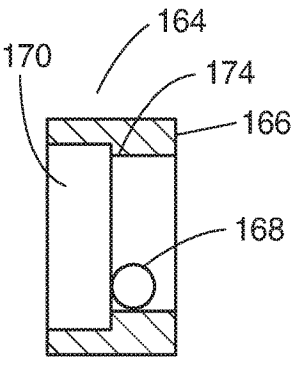
FIG. 20 is a cross sectional view of a bubble level cap, which is sized to be received by an exit end of a scope in accordance with the present invention.
Figure 19:
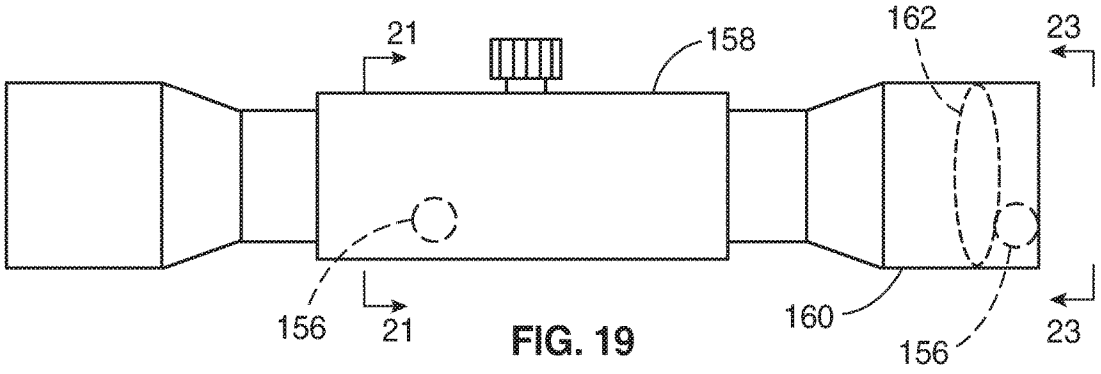
FIG. 19 is a side view of a scope with a bubble level retained therein near a middle of a length of the scope and a second bubble level retained outside the scope in accordance with the present invention.
Figure 23:
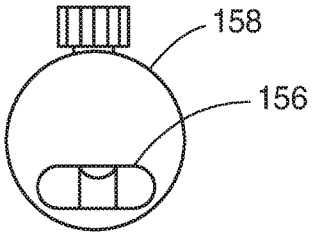
FIG. 23 is a rear view of a scope with a bubble level in accordance with the present invention.
Figure 22:
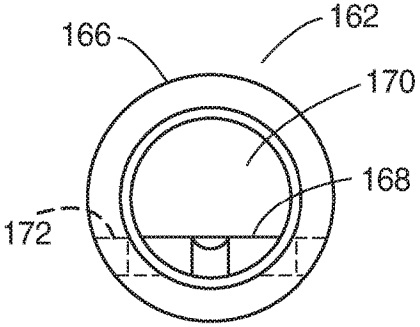
FIG. 22 is a front view of a bubble level cap in accordance with the present invention.
Figure 21:
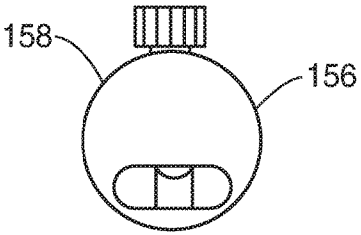
FIG. 21 is a cross sectional view of a scope with a bubble level cut through FIG. 19 illustrating a first bubble level inside the scope case in accordance with the present invention.

With reference to FIGS. 19, 21 and 23, a bubble level 156 may be made as an integral portion of a scope 158. The bubble level 156 can be located inside the scope 158 near a middle of a length and near a bottom of a case wall 160. The bubble level 156 may also be located in front of an exit lens 162, near a bottom of the case wall 160. With reference to FIGS. 20 and 22, a bubble level cap 164 may also be pushed over an exit end of the scope 158. The bubble level cap 164 includes a cap member 166 and a bubble level 168. The cap member 166 includes a counter bore 170, which is sized to receive an outer diameter of a scope case exit end. A level hole 172 is formed through the cap member 166 near a bottom of a smaller counter bore diameter 174 to receive the bubble level 168.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An adjustable arrow rest comprising:

at least one bracket;

at least one guide rod having one end retained in said at least one bracket, said at least one bracket includes a front bracket and a rear bracket, said front bracket retains one end of said at least one guide rod, said rear bracket retains an opposing end of said at least one guide rod;

a linear carriage is adjustable relative to a length of said at least one guide rod; and an arrow support frame is retained by said linear carriage, said arrow support frame is vertically adjustable relative to said linear carriage, wherein said arrow support frame provides adjustable support for an arrow shaft.

2. The adjustable arrow rest of claim 1 wherein:

said linear carriage includes a carriage base and a t-nut retainer block which extends from a top of said carriage base, a t-nut slot is formed in a front of said t-nut retainer block, a flange clearance slot is formed in a top of said t-nut retainer block behind said t-nut slot.

3. The adjustable arrow rest of claim 2, further comprising:

a t-nut includes a nut body, a flange base, an adjustment threaded hole and a threaded retention hole, said flange base extends outward from a bottom of said nut body, an axis of said adjustment threaded hole formed through said nut body is parallel with a bottom of said flange base, said nut body is moveably retained in said t-nut slot, said flange base is moveably retained in said flange slot.

4. An adjustable arrow rest comprising:

at least one bracket;

at least one guide rod having one end retained in said at least one bracket;

a linear carriage is adjustable relative to a length of said at least one guide rod; and an arrow support frame is retained by said linear carriage, said arrow support frame is vertically adjustable relative to said linear carriage, a vertical stem extends downward from a bottom of said arrow support frame for retention by said linear carriage, wherein said arrow support frame provides adjustable support for an arrow shaft.

5. The adjustable arrow rest of claim 4 wherein:

said linear carriage includes a carriage base and a t-nut retainer block which extends from a top of said carriage base, a t-nut slot is formed in a front of said t-nut retainer block, a flange clearance slot is formed in a top of said t-nut retainer block behind said t-nut slot.

6. The adjustable arrow rest of claim 5, further comprising:

a t-nut includes a nut body, a flange base, an adjustment threaded hole and a threaded retention hole, said flange base extends outward from a bottom of said nut body, an axis of said adjustment threaded hole formed through said nut body is parallel with a bottom of said flange base, said nut body is moveably retained in said t-nut slot, said flange base is moveably retained in said flange slot.

7. The adjustable arrow rest of claim 4, further comprising:

a lateral carriage includes a stem retainer and an adjustment projection that extends from said stem retainer, a stem opening is formed through said stem retainer to receive said vertical stem, a slit is formed through said stem opening, a fastener is used to clamp said vertical stem in said stem opening, a vertical adjustment screw is retained in said adjustment projection to engage said vertical stem.

8. An adjustable arrow rest comprising:

at least one bracket;

at least one guide rod having one end retained in said at least one bracket;

a linear carriage is adjustable relative to a length of said at least one guide rod; and an arrow support frame is retained by said linear carriage, said arrow support frame is vertically adjustable relative to said linear carriage, said arrow support frame includes a base frame, a vertical leg and a horizontal leg, said vertical leg extends upward from one end of said base frame, said horizontal leg extends inward from a top of said vertical leg, wherein said arrow support frame provides adjustable support for an arrow shaft.

9. The adjustable arrow rest of claim 8 wherein:

said linear carriage includes a carriage base and a t-nut retainer block which extends from a top of said carriage base, a t-nut slot is formed in a front of said t-nut retainer block, a flange clearance slot is formed in a top of said t-nut retainer block behind said t-nut slot.

10. The adjustable arrow rest of claim 9, further comprising:

a t-nut includes a nut body, a flange base, an adjustment threaded hole and a threaded retention hole, said flange base extends outward from a bottom of said nut body, an axis of said adjustment threaded hole formed through said nut body is parallel with a bottom of said flange base, said nut body is moveably retained in said t-nut slot, said flange base is moveably retained in said flange slot.

11. The adjustable arrow rest of claim 8 wherein:

a bubble level is retained in said arrow support frame, wherein said adjustable arrow rest is attached to a bow such that a top said bubble level is viewable at a bottom of a scope lens of a scope.

* * * * *